US006140970A

United States Patent [19]

Ylijurva

[11] Patent Number: 6,140,970

[45] Date of Patent: Oct. 31, 2000

[54] RADIO ANTENNA

[75] Inventor: Teija Anitta Ylijurva, Grapevine, Tex.

[73] Assignee: Nokia Mobile Phones Limited, Espoo, Finland

[21] Appl. No.: 09/302,599

[22] Filed: Apr. 30, 1999

[51] Int. Cl.[7] ..... H01Q 1/24

[52] U.S. Cl. ..... 343/702; 343/906

[58] Field of Search ..... 343/702, 906, 343/700 MS; 342/379; 375/347; 455/90, 575; H01Q 1/24

[56] References Cited

U.S. PATENT DOCUMENTS

| | | | |
|---|---|---|---|
| 4,644,359 | 2/1987 | Katagi et al. | 342/379 |
| 4,771,291 | 9/1988 | Lo et al. | 343/700 MS |
| 4,958,382 | 9/1990 | Imanishi | 343/702 |
| 4,980,694 | 12/1990 | Hines | 343/702 |
| 5,446,783 | 8/1995 | May | 455/90 |
| 5,649,306 | 7/1997 | Vannatta et al. | 343/702 |
| 5,692,019 | 11/1997 | Chang et al. | 375/347 |
| 5,722,089 | 2/1998 | Murakami | 455/575 |
| 5,835,063 | 10/1998 | Brachat et al. | 343/700 MS |
| 5,867,131 | 2/1999 | Camp, Jr. et al. | 343/797 |
| 5,936,581 | 8/1999 | Roshitsh et al. | 343/702 |
| 5,936,582 | 8/1999 | Wallace et al. | 343/702 |
| 5,940,040 | 8/1999 | Koyanagi et al. | 343/702 |
| 5,949,379 | 9/1999 | Yang | 343/702 |
| 5,950,116 | 9/1999 | Baro | 343/702 |

FOREIGN PATENT DOCUMENTS

| | | |
|---|---|---|
| 0272145A2 | 6/1988 | European Pat. Off. . |
| 0642190 | 3/1995 | European Pat. Off. . |
| 0714151 | 5/1995 | European Pat. Off. . |
| WO95/24745 | 9/1995 | WIPO . |

OTHER PUBLICATIONS

Patent Abstracts of Japan, vol. 18, No. 340 (E–1569), Jun. 27, 1994 & JP 06 085526 A (Nippon Mektron), Mar. 25, 1994—Abstract.

*Primary Examiner*—Don Wong
*Assistant Examiner*—Hoang Nguyen
*Attorney, Agent, or Firm*—Jerald Gnuschke; Brian T. Rivers

[57] ABSTRACT

A mobile radio antenna configuration scheme. A first embodiment discloses an extendable first antenna for a mobile radio that can serve as an alternative to, or in conjunction with, an internal second antenna. When in the stored position, the first antenna is disposed within the mobile radio casing so that the form factor advantages of using internal antennas are obtained. When fully extended, the majority of the first antenna is external to the mobile phone. In another embodiment, the mobile radio transceiver engine is switched from the second antenna to the first antenna upon extension of the first antenna. In another embodiment, the transceiver is connected to both antennas. In another embodiment, the antenna with the strongest signal is connected to the transceiver when the extendable antenna is extended. In another embodiment, an antenna module inserts into a mobile radio. The antenna module may have various antenna combinations for custom configuration of the mobile radio.

14 Claims, 3 Drawing Sheets

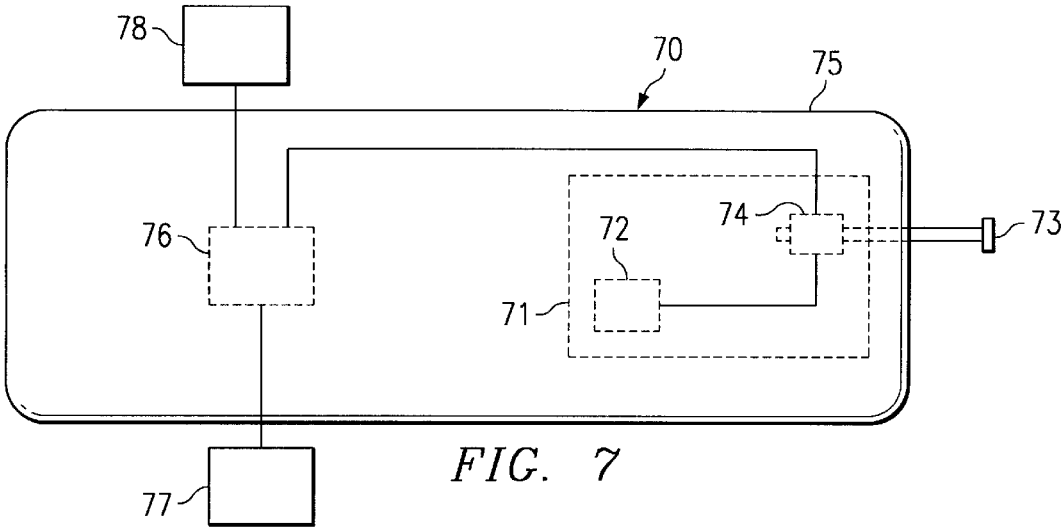
FIG. 7
FIG. 6A
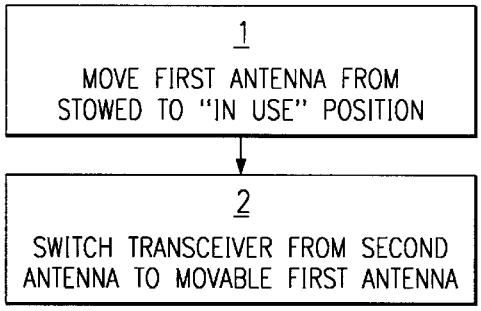
FIG. 6B
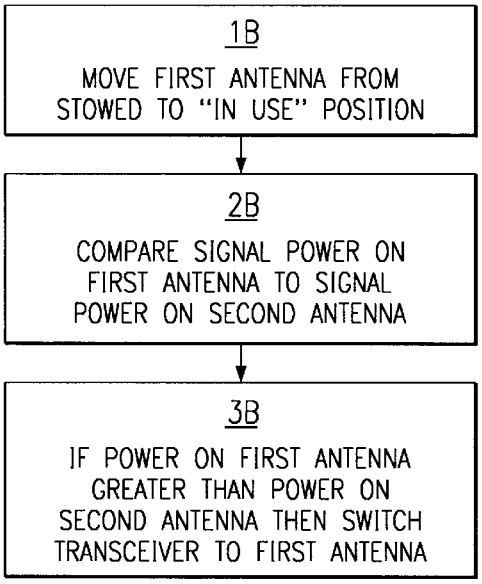
FIG. 6C
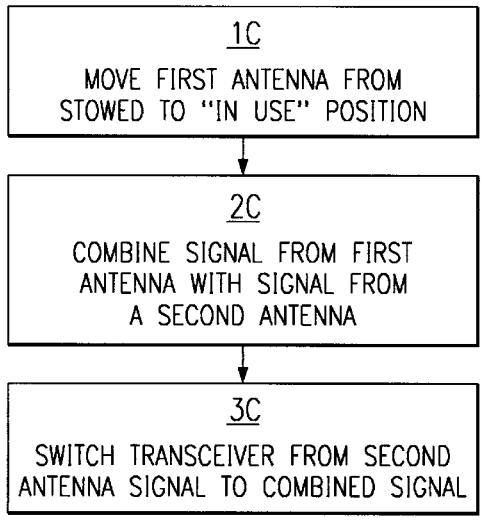

RADIO ANTENNA

FIELD OF THE INVENTION

The present application relates, in general, to mobile radio antennas and, more particularly, to mobile radios with a non-movable internal antenna and an extendable antenna.

BACKGROUND OF THE INVENTION

Without limiting the scope of the invention, its background is described in connection with the following: Antennas; and User Interference (Body Effect).

An antenna converts electrical current to and from electromagnetic waves. Antennas are passive devices that can couple mutually. An antenna's "gain" is based on its directivity and efficiency (lack of dissipative losses). Directivity is an antenna's ability to focus energy in a desired direction. If desired, energy can be focused into a narrow beamwidth. This focused energy gives the ability to communicate over great distances, but as the angle of the antenna changes, the direction of the beam also changes, thus requiring proper orientation of the antenna for a good signal.

An antenna is designed for maximal "gain" at a particular frequency. Conventionally this is accomplished by calculating the wavelength of the desired frequency and designing an antenna that is a fraction of the wavelength. Typical antennas are a quarter wavelength to ⅝ths of a wavelength long. Under the Global System for Mobile communication (GSM), which is standardized at approximately 900 MHz and 1800 MHz, a typical GSM mobile radio may need to operate in dual band mode. If the mobile radio has the capability for dual band operation, the antenna must be designed to operate at approximately 900 MHz (wavelength of 32.8 cm) and 1800 Mhz (wavelength of 15.6 cm). FIG. 1 shows a typical prior art example of a dual band antenna with quarter wavelength elements. Mobile radio 10 has an external dual band antenna 16 containing elements 12 and 14. Under the GSM system described above, antenna 14 would be about 3.9 cm for 1800 Mhz operation and antenna 12 about 8.2 cm for 900 Mhz operation. Of course, dual band antennas are applicable not just to GSM systems but also to Time Division Multiple Access (TDMA) systems and Code Division Multiple Access (CDMA) systems.

Antennas used with transmitting radios are often dipoles involving two elements: the radio case and an appendage to the radio case like a whip or helical wound whip. The combination of the case and the whip form an off-center-fed dipole. Above 800 MHz, the helix-radio combination is generally longer than a half-wave, so the radiation pattern no longer has a peak at the horizon. This results in a significant performance penalty and is the reason why a coaxial dipole is may be used at frequencies above 800 MHz.

Antennas that usually are associated with personal communication devices (PCD) are small, both electrically and physically. The communication devices are usually worn on the body or held in the hand. Due to the antenna's proximity to the user's body, the user often becomes part of the antenna system.

Internal antennas for personal communication devices offer an advantageous form factor that is convenient for slipping the device in a pocket or purse. External antennas increase the length of the PCD and often snag when the device is being removed from, or returned to, a pocket or purse. Unfortunately, when using an internal antenna in some situations, reception and transmission may be hindered by various factors, such as placement of the user's head or hand between the PCD and its base station.

The user's body causes a type of interference, known as the "body effect," that is of particular concern for mobile radio. Basically, the human body can be thought of as a large column of salt water that conducts electromagnetic waves away from the mobile radio's transceiver. In the case of cellular telephones, this effect is intensified because the user often covers part of the antenna with his hand when using the telephone. There is significant loss when the radio is held in the hand because the hand is wrapped around one of the antenna dipole elements. Many users rest their fingers on the external antenna when using the telephone, further increasing signal loss.

The standing human body behaves essentially like an inefficient wire antenna at frequencies below about 150 MHz. The body exhibits a whole-body resonance to vertical polarization that can contribute significantly to VHF radio system link margin. The erect body is resonant to vertically polarized incident fields in the range of about 40 to 80 MHz, depending on the presence and type of ground. That is, the body on a perfectly conducting ground looks like a quarter-wave element with a ground image, so its resonant length is about 3.4 m, while in free space the resonant length is 1.7 m. At frequencies of interest to cellular phone operation, the user can cause a drop in power of 5 to 20 dB, sometimes greater, by covering the antenna with his hand.

With the advent of electronic address books and schedulers, users of portable electronics, such as cellular telephones or laptop computers, often wish to exchange data with other electronic devices. For many years the standard solution was to connect a data cable between the devices. This method was inconvenient because it required the user of the portable device to carry a data cable.

A relatively recent innovation is a wireless data link. Essentially, the necessity of a data cable has been eliminated by use of wireless technology to transmit data. For consumer electronics, one of the most common wireless links is an infra-red optical link. They have become so popular that infra-red wireless links are included in some cellular telephones.

A great many mobile telephones have an infra-red data port even though they do not have infra-red communication capability. Many distinct models of mobile telephone use the same external casing in order to obtain efficiency of scale during manufacture. Because mobile telephone engines have different capabilities, not all engines need every feature of the external casing. For example, an engine that does not support an infra-red (IR) data link to a personal computer does not utilize the IR data port in its casing. A manufacturer may still sell this engine in the casing that has a data port because it is more economical than making a custom casing without the data port.

In summary, internal antennas for personal communication devices have the disadvantage that the user's body can interfere with reception and transmission of signals. External antennas have the disadvantage that the user often interferes with the signals by touching the antenna. As discussed above, touching or close proximity to the antenna can cause significant power loss. External antennas have the additional disadvantage that they snag easily and generally make a cellular telephone more cumbersome. Finally, many cellular telephones have infra-red data ports that they are not capable of utilizing.

Additional general background, which helps to show the knowledge of those skilled in the art regarding the system context, and of variations and options for implementations, may be found in the following: Harte, et al., GSM Superphones (1999); Lee, Mobile Cellular Telecommunications (1995); Siwiak, Radiowave Propagation and Antennas for Personal Communications (1998); Webb, Understanding Cellular Radio (1998); all of which are hereby incorporated by reference.

SUMMARY OF THE INVENTION

The present application discloses an extendable first antenna for a mobile radio that can serve as an alternative to, or in conjunction with, a fixed internal second antenna.

The presently preferred embodiment is incorporated in a mobile cellular telephone. In the presently preferred embodiment, an extendable first antenna, when in the stored position, is disposed within a mobile telephone casing so that the form factor advantages of using internal antennas are obtained. When fully extended, the majority of the extendable antenna is external to the mobile phone. Upon extension of the first antenna, the mobile telephone transceiver engine is switched from the fixed internal antenna to the extendable antenna.

Other antenna configurations are possible. In an alternate embodiment, the transceiver is connected to both antennas and signal processing may be used to combine the signals from both antennas. In another embodiment, the antenna with the strongest signal is connected to the transceiver when the extendable antenna is extended.

In the presently preferred embodiment, the extendable first antenna can be added without external redesign of the phone casing. An infra-red data port window on a mobile telephone casing is removed to create an opening for extension of an extendable antenna. In this embodiment, the tip of the extendable first antenna is recessed inside the body of the casing when the first antenna is fully retracted. Alternate embodiments which do not have infra-red capability may replace the plastic infra-red window with a rubber cover, thus reducing susceptibility to damage when dropped.

In another embodiment, an antenna module inserts into a mobile radio. The antenna module may have various antenna combinations for custom configuration of the mobile radio. The module may contain a fixed and/or a movable antenna. The module may be used with, or without, a second antenna disposed within the mobile radio.

The disclosed innovations, in various embodiments, provide one or more of at least the following advantages: an extendable antenna for use in situations in which a fixed internal antenna does not perform well; protection from antenna damage and snagging because the extendable antenna tip is recessed within the casing when fully retracted; an extendable antenna that may be used in conjunction with a fixed internal antenna; increased resistance to drop damage by replacing the infra-red window with a rubber cover; a casing that maintains external antenna capability but is less likely to snag than a standard casing with an external antenna; or a quick, internal method for switching a transceiver engine from a fixed internal antenna to an extendable antenna.

BRIEF DESCRIPTION OF THE DRAWINGS

The disclosed inventions will be described with reference to the accompanying drawings, which show important sample embodiments of the invention and which are incorporated in the specification hereof by reference, wherein:

FIGS. 6A–6C depicts a flow charts of a method of switching a transceiver between a plurality of antennas.

FIG. 7 depicts a wireless modem having an internal and external antenna.

DETAILED DESCRIPTION OF THE PREFERRED EMBODIMENTS

The numerous innovative teachings of the present application will be described with particular reference to the presently preferred embodiment. However, it should be understood that this class of embodiments provides only a few examples of the many advantageous uses of the innovative teachings herein. In general, statements made in the specification of the present application do not necessarily delimit any of the various claimed inventions. Moreover, some statements may apply to some inventive features but not to others.

Definitions

Casing: The enclosure around a consumer electronics device. As an example, the plastic and rubber exterior of a cellular mobile telephone.

Extendable Antenna: An antenna that may be extended from a casing.

External Antenna: An antenna that, when being used, is at least partially external to a casing.

Fixed Antenna: An antenna that is not movable, i.e. not retractable or extendable.

Internal Antenna: A fixed antenna that is disposed within a casing.

IRDP: Infra-red Data Port.

Stripline Antenna: A microstrip antenna or patch antenna.

Transceiver Engine: A cellular radio's internal electronics, usually refers to the transceiver, synthesizer, and baseband electronics, excluding the antenna and mechanical components (such as the casing).

Figure 2:
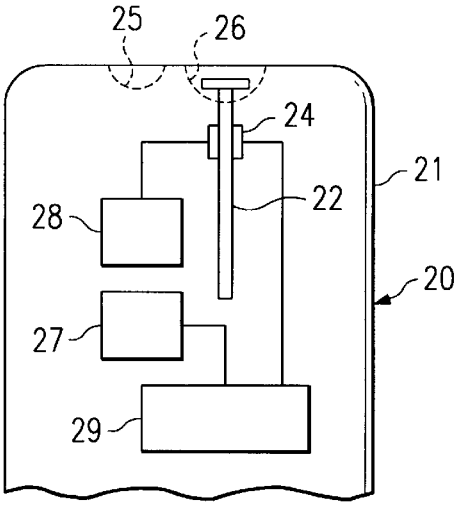
FIG. 2 shows an extendable antenna, according to an embodiment of the present invention, in its retracted or "stowed" position.

Referring to FIG. 2, a mobile cellular telephone is illustrated in accordance with the presently preferred embodiment and denoted generally as 20. For ease of comparison with FIG. 3, discussed below, power plug 25 has been depicted. In the presently preferred embodiment, cell phone 20 does not use an infra-red data port and thus the entire port cavity 26 is available for antenna storage. An extendable antenna 22 is shown fully retracted in its stowed position. Antenna 22 may be a helix, whip, Zig Zag, meander, sleeve dipole, dipole, or any other suitable type of antenna. In its stowed position, antenna 22 is internal to casing 21. The tip of antenna 22 is recessed within the infra-red data port cavity 26 in casing 21. A plastic window or a rubber cover may be used to cover the cavity 26. Transceiver engine 29 is switched between internal antenna 28 and extendable antenna 22 by switch 24.

In an alternate embodiment, optional signal processor 27 may be incorporated to handle signal routing decisions. For example, signal processor 27 could compare signal strength on both antennas 22, 28 and connect the transceiver engine 29 to the antenna with the strongest signal. In another example, signal processor 27 could combine the received signal from antennas 22 and 28, effectively summing the signals for increased signal power. The combined signal would then be routed to the transceiver engine 29. Signal processor 27 could be an independent processor, as shown in FIG. 2, or incorporated into transceiver engine 29.

Figure 3:
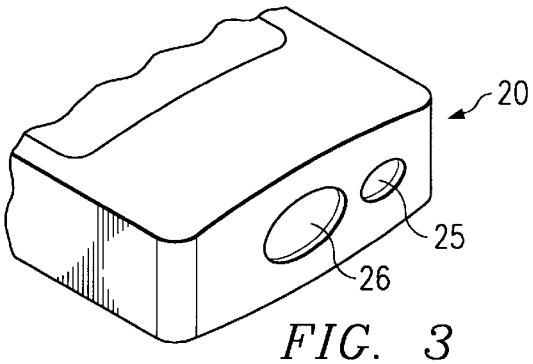
FIG. 3 shows an extendable antenna, according to an embodiment of the present invention, in its extended or "in use" position.

FIG. 3 shows an example mobile cellular telephone casing 20 with an infra-red data port 26 located next to a power plug 25. For clarity, a cover for data port 26 is not shown. The cellular phone casing 20 advantageously does not have external antenna protrusions. In a cellular telephone incorporating the presently preferred embodiment, an extendable antenna 22 is contained within the casing 20. When the user switches from the internal antenna 28 to the extendable antenna 22, the user would pull the cover off of the data port 26, grasp the tip of the antenna 22, and extend it. When the antenna 22 is fully extended (the "in-use" position) the transceiver 29 is switched to the extendable antenna 22 by switch 24 (not shown in FIG. 3). Note that in the presently preferred embodiment infra-red data port 26 is sufficiently large to allow the user to easily grasp the tip of the extendable antenna 22.

Figure 4:
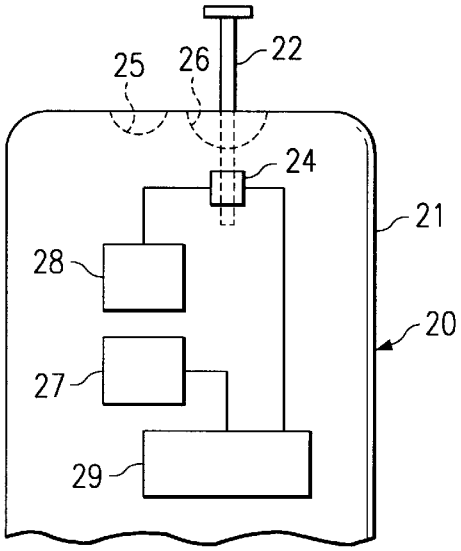
FIG. 4 shows an alternate embodiment of the disclosed innovation with an extendable antenna rotating about a pivot point.

Referring to FIG. 4, a mobile cellular telephone 20 is illustrated in accordance with the presently preferred embodiment. An extendable antenna 22 is shown in its fully extended "in-use" position. In its "inuse" position, the majority of antenna 22 is external to casing 21. When antenna 22 is fully extended, transceiver engine 29 is switched from internal antenna 28 to extendable antenna 22 by switch 24. For ease of comparison with FIGS. 2 and 3, power plug 25 has been depicted. Optional signal processor 27 operates as described above.

Referring to FIG. 6A, an example of a quick method of switching a transceiver between a plurality of antennas is shown in accordance with the present invention. In step 1, a movable antenna is moved from a stowed position to an "in-use" position. In step 2, after the movable antenna is moved to the "in-use" position, a transceiver is switched from a second antenna to the movable antenna.

As an additional example, FIG. 6B shows a method of switching a transceiver between a plurality of antennas that includes signal power evaluation. In step 1B, a movable antenna is moved from a first position to a second position. In step 2B, the signal strength of each antenna is evaluated and compared. Then, in step 3B, the transceiver would be switched to the antenna with the greatest signal strength.

As an additional example, FIG. 6C shows a method of switching a transceiver from a single antenna to a plurality of antennas. In step IC, a movable antenna is moved from a first position to a second position. In step 2C, the signals from each antenna are combined so that they are effectively summed, resulting in improved signal. In step 3C, the combined signal is provided to the transceiver.

Figure 5:
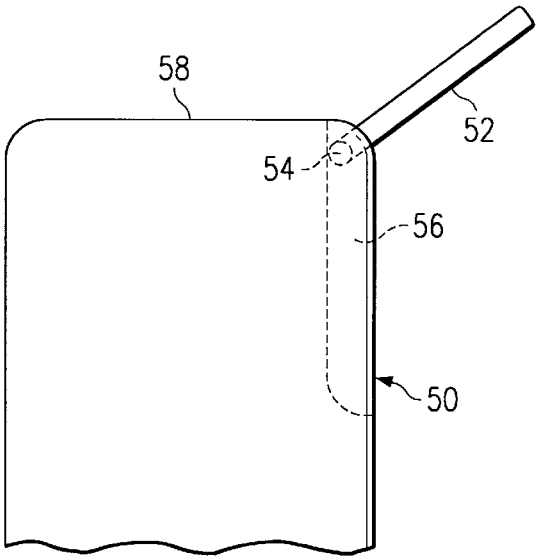
FIG. 5 depicts a casing of a mobile cellular phone with an infra-red window.

Referring to FIG. 5, a mobile cellular telephone 50 is illustrated in accordance with an alternate embodiment of the present invention. In this embodiment, antenna 52 is contained in a groove 56 along a side of the cell phone casing 58. Antenna 52 rotates (rather than extending through the IRDP as in the presently preferred embodiment) about a pin 54 attaching it to the cell phone case 58.

Referring to FIG. 7, a computer 70 is shown in accordance with an embodiment of the present invention. A radio modem 71 is disposed within the case 75 of computer 70. The radio modem 71 has a movable antenna 73 and a second antenna 72. When the movable antenna 73 is moved from a stowed position to an "in-use" position, the radio modem is switched from the second antenna to the movable antenna. In an alternate embodiment, the radio modem could be internal as shown in FIG. 7 or external, perhaps for use with laptop computers. All of the previously mentioned embodiments may be applicable to radio modems as well.

Figure 8A:
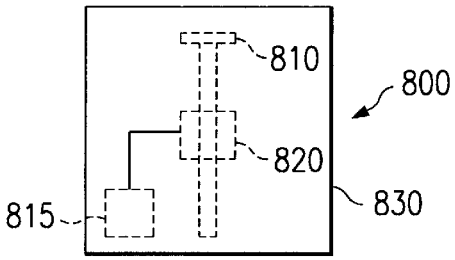
FIG. 8A depicts an antenna module with a movable antenna in the stowed position.

Referring to FIG. 8A, an antenna module 800 is shown in accordance with an embodiment of the present invention. In its present embodiment, the module 800 is an optional self-contained unit that can be installed in any mobile telephone designed to accept it. A movable antenna 810 and a switch 820 are disposed within the module's casing 830. Movable antenna 810 is shown in its stowed position. When antenna 810 is in the stowed position, the switch 820 is electrically "open" with respect to antenna 810.

Figure 8B:
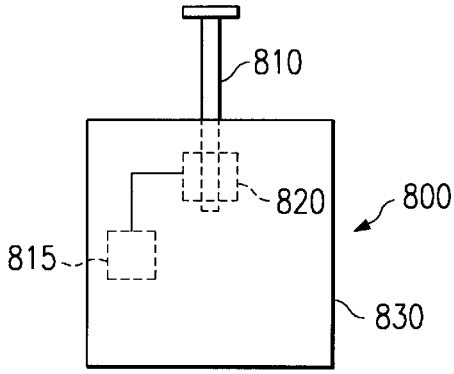
FIG. 8B depicts an antenna module with a movable antenna in the "in-use" position.

Referring to FIG. 8B, antenna module 800 is shown with antenna 810 in the "in-use" position. When antenna 810 is in the "inuse" position, the switch 820 is electrically "closed" with respect to antenna 810.

Figure 8C:
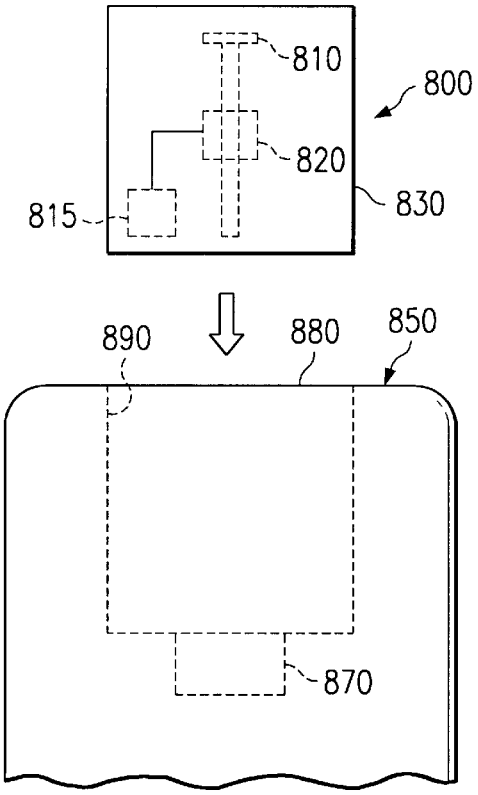
FIG. 8C depicts an antenna module prior to insertion in a cellular telephone.

Referring to FIG. 8C, antenna module 800 is shown prior to insertion into a mobile telephone 850. A user would remove the cover (not shown for ease of description) from the infra-red data port 880 and insert antenna module 800 into the data port cavity 890. After insertion, the antenna module makes electrical contact with connector 870.

Figure 8D:
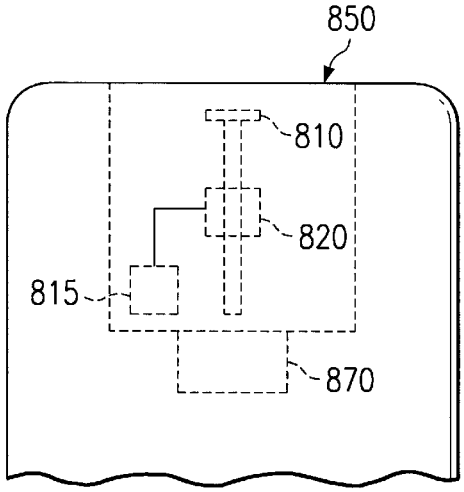
FIG. 8D depicts a cellular telephone with an antenna module installed.

Referring to FIG. 8D, mobile telephone 850 is shown with antenna module 800 inserted. Antenna 810 is shown in the stowed position. In the embodiment shown, antenna module 800 is disposed completely within mobile telephone 850 when antenna 810 is in the stowed position.

In alternate embodiments, the antenna module 800 described in FIGS. 8A–8D may be used with or without an additional antenna (such as fixed internal antenna 28 shown in FIG. 2) disposed within the mobile telephone. The only antenna in the mobile telephone may be in the antenna module 800.

In an alternate embodiment of the innovation disclosed in FIGS. 8A–8D, the antenna module 800 can contain a fixed antenna 815 and/or a movable antenna. Obviously, switch 820 is not necessary in modules that contain only fixed antennas. The fixed antenna could be a microstrip, helix, whip, Zig Zag, meander, sleeve dipole, dipole, or any other suitable type of antenna. This alternate embodiment allows a user to purchase a cellular telephone and customize it with the antenna of his choice. If the user desires an internal antenna, the user selects a plug-in module containing a microstrip antenna. If the user wants a fixed helix antenna, the user selects a module having a fixed helix antenna. If the user wants a movable helix antenna, the user selects a module having a movable helix.

As will be recognized by those skilled in the art, the innovative concepts described in the present application can be modified and varied over a tremendous range of applications, and accordingly the scope of patented subject matter is not limited by any of the specific exemplary teachings given.

For example, the switching device (shown in FIGS. 2 and 3 as component 24) that switches the transceiver engine from the fixed internal antenna to the extendable antenna could be a mechanical switch, a Hall effect switch, an optical switch, or any other suitable switch.

As another example, the infra-red data port cavity (shown in FIGS. 2 and 3 as component 26) could be covered by a removable plastic window, a removable rubber cover, any other suitable cover, or could be uncovered.

As another example, any suitable space in a mobile cell phone could be substituted for the infra-red data port cavity (shown in FIGS. 2 and 3 as component 26).

As another example, the extendable antenna could be supplied as an option kit (perhaps a self-contained modular plug-in). With the kit, a user or a service center could upgrade cellular telephones that have only an internal antenna. In one variation of this example, the cell phone could be manufactured with a plug-in connector that would allow a technologically unsophisticated user to easily install the option kit.

As another example, the disclosed innovations can be used with digital or analog cellular radio systems.

Figure 1:
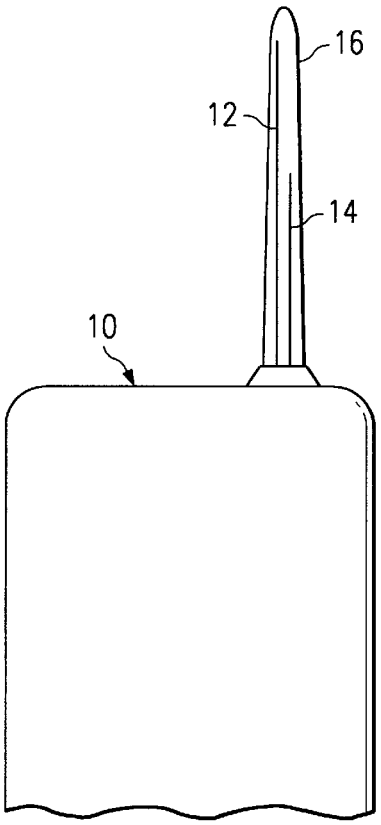
FIG. 1 (PRIOR ART)
FIG. 1 shows a prior art dual mode antenna.

As another example, the extendable antenna could support a multiplicity of bands. Such a dual (or more) band antenna might be constructed with a multiplicity of antenna elements, similar to the dual band antenna shown in FIG. 1.

As another example, with the proper signal processing techniques either the internal and extendable antennas could be used at the same time (effectively summing the signals) or the antenna with the best "gain" could be used.

As another example, the extendable antenna may be of any suitable type, not just a helix, whip, Zig Zag, meander, sleeve dipole, or dipole antenna.

What is claimed is:

1. A mobile transceiver, comprising:

a casing;

a transceiver engine disposed within said casing;

a first antenna, said first antenna fixed within said casing and coupled to said transceiver engine; and a second antenna, said second antenna movable between a first position and a second position;

wherein said second antenna is electrically connected to said transceiver when in said second position; and wherein said second antenna is disposed completely within said casing when said second antenna is in said first position.

2. The mobile transceiver of claim 1, further comprising a switch;

wherein said first and second antennas are coupled to said transceiver engine through said switch; and wherein said first and second antennas are each electrically connected to said transceiver engine, respectively, by moving said second antenna between said first and second position.

3. The transceiver of claim 1, further comprising a signal processor;

wherein said first and second antennas are coupled to said transceiver engine through said signal processor; and wherein said signal processor combines signals from said first and second antennas for input to said transceiver engine.

4. The transceiver of claim 1, further comprising a signal processor;

wherein said first and said second antennas are coupled to said transceiver engine through said signal processor; and wherein said signal processor signals to said transceiver engine from the antenna, selected from the group of said first and said second antenna, receiving the strongest signal.

5. The transceiver of claim 1, wherein a majority of said second antenna protrudes from said casing when said second antenna is moved to said second position.

6. The transceiver of claim 1, wherein said casing has an opening through which said second antenna protrudes when extended.

7. The transceiver of claim 1, wherein said casing has no protruding portion for receiving said second antenna.

8. A wireless modem, comprising:

a wireless modem;

a first antenna, said first antenna electrically connected to said modem; and a second antenna, electrically connected to said modem and movable from a first position to a second position;

wherein said modem switches from said first antenna to said second antenna when said second antenna is moved from said first position to said second position, respectively.

9.The system of claim 8, further comprising a computer;

wherein said first antenna is disposed within said computer.

10. The system of claim 8, wherein said first antenna is disposed within said wireless modem.

11. A mobile telephone system, comprising:

a mobile telephone, said mobile telephone having a first electrical connector disposed within said mobile telephone; and an antenna module, said antenna module comprising at least one fixed antenna and at least one movable antenna;

wherein said antenna module inserts into said mobile telephone and electrically connects with said first electrical connector.

12. The mobile telephone system of claim 11, wherein said antenna module comprises at least one antenna, said at least one antenna movable between a first and second position.

13. The mobile telephone system of claim 11, wherein said antenna module comprises at least one fixed antenna.

14. A computer system, comprising:

at least one microprocessor;

at least one user input device;

a display device; and a wireless modem comprising a first antenna coupled to said modem; and a second antenna, coupled to said modem and movable from a first position to a second position;

wherein said modem switches from said first antenna to said second antenna when said second antenna is moved from said first position to said second position.

* * * * *